US010104954B1

(12) United States Patent
Hamby

(10) Patent No.: US 10,104,954 B1
(45) Date of Patent: Oct. 23, 2018

(54) PORTABLE TRAY FOR A FOLDING CHAIR

(71) Applicant: John Hamby, Walla Walla, WA (US)

(72) Inventor: John Hamby, Walla Walla, WA (US)

( * ) Notice: Subject to any disclaimer, the term of this patent is extended or adjusted under 35 U.S.C. 154(b) by 0 days.

(21) Appl. No.: 15/791,579

(22) Filed: Oct. 24, 2017

(51) Int. Cl.

| | |
|---|---|
| ***A47B 23/00*** | (2006.01) |
| ***A47B 37/00*** | (2006.01) |
| ***A47B 5/06*** | (2006.01) |
| ***A47B 9/20*** | (2006.01) |
| ***A47B 5/02*** | (2006.01) |

(52) U.S. Cl.
CPC ..... *A47B 5/06* (2013.01); *A47B 5/02* (2013.01); *A47B 9/20* (2013.01)

(58) Field of Classification Search
CPC ..... A47B 5/06; A47B 5/02; A47B 9/20
USPC ..... 108/42, 144.11, 147.19, 147.2, 147.21, 108/156, 159, 157.17, 157.15, 157.13
See application file for complete search history.

(56) References Cited

U.S. PATENT DOCUMENTS

| | | | | |
|---|---|---|---|---|
| 2,602,012 | A * | 7/1952 | Doty | F16B 12/52 108/158 |
| 2,730,419 | A * | 1/1956 | Roberton | A47B 13/021 108/156 |
| 4,494,465 | A * | 1/1985 | Fick, Jr. | A47B 3/083 108/131 |
| 5,720,516 | A * | 2/1998 | Young | A47C 7/68 297/188.14 |
| 5,918,550 | A | 7/1999 | Weir | |
| 5,947,032 | A * | 9/1999 | Meier | A47B 5/06 108/33 |
| 6,109,580 | A | 8/2000 | Stern | |
| 6,425,480 | B1 * | 7/2002 | Krueger | A47G 19/065 206/217 |
| 6,691,627 | B2 * | 2/2004 | Einsel | A47C 7/70 108/147.21 |
| 6,732,990 | B2 | 5/2004 | Hudson | |
| 7,243,991 | B2 | 7/2007 | Ojeda | |
| 7,290,746 | B1 | 11/2007 | Macias | |
| D573,407 | S | 7/2008 | Cox | |
| 7,798,076 | B1 * | 9/2010 | Neff | A47B 87/0215 108/157.13 |
| 8,245,650 | B1 * | 8/2012 | McKsymick | A47B 3/10 108/25 |
| 8,827,220 | B2 * | 9/2014 | Eriksen | A47B 9/083 108/158 |
| 2006/0220423 | A1 | 10/2006 | Bergin | |

(Continued)

FOREIGN PATENT DOCUMENTS

| | | |
|---|---|---|
| CA | 2536723 | 2/2014 |

*Primary Examiner* — Daniel J Troy
*Assistant Examiner* — Timothy M Ayres
(74) *Attorney, Agent, or Firm* — Kyle A. Fletcher, Esq.

(57) ABSTRACT

The portable tray for a folding chair is a table. The portable tray for a folding chair is configured for use with a drink holder. The portable tray for a folding chair attaches to the drink holder such that a portion of the load path of the portable tray for a folding chair transfers through the drink holder to the supporting surface that supports the structure containing the drink holder. The portable tray for a folding chair comprises a tray, a telescopic stanchion, and a stabilizer. The tray is a horizontal surface that is used to support objects. The telescopic stanchion is a vertical support that raises the tray above the supporting surface. The stabilizer is a device that attaches the tray to the drink holder. The vertical span of the telescopic stanchion is adjustable.

17 Claims, 6 Drawing Sheets

(56) References Cited

U.S. PATENT DOCUMENTS

| | | | | |
|---|---|---|---|---|
| 2008/0224505 | A1* | 9/2008 | Gerard | A47B 83/02 297/161 |
| 2011/0000404 | A1* | 1/2011 | Lauther | A47B 5/06 108/35 |
| 2017/0042321 | A1* | 2/2017 | Clause | A47B 13/021 |

* cited by examiner

COTTER PIN

SPRING LOADED BALL LOCK

G SNAP COLLAR

SPLIT COLLAR LOCK

THREADED CLUTCH

INTERNAL CAM LOCK

PORTABLE TRAY FOR A FOLDING CHAIR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including furniture, a table with separable parts.

SUMMARY OF INVENTION

The portable tray for a folding chair is a table. The portable tray for a folding chair is configured for use with a drink holder. In the first potential embodiment of the disclosure, the drink holder is further defined with a chair. As used in this disclosure, a drink holder refers to a cavity that is designated to hold a beverage contained in a can or a bottle. The portable tray for a folding chair attaches to the drink holder such that a portion of the load path of the portable tray for a folding chair transfers through the drink holder to the supporting surface that supports the structure containing the drink holder. The portable tray for a folding chair comprises a tray, a telescopic stanchion, and a stabilizer. The tray is a horizontal surface that is used to support objects. The telescopic stanchion is a vertical support that raises the tray above the supporting surface. The stabilizer is a device that attaches the tray to the drink holder. The vertical span of the telescopic stanchion is adjustable.

These together with additional objects, features and advantages of the portable tray for a folding chair will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable tray for a folding chair in detail, it is to be understood that the portable tray for a folding chair is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable tray for a folding chair.

It is therefore important that the claims be regarded as including such equivalent construction insofar as they do not depart from the spirit and scope of the portable tray for a folding chair. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
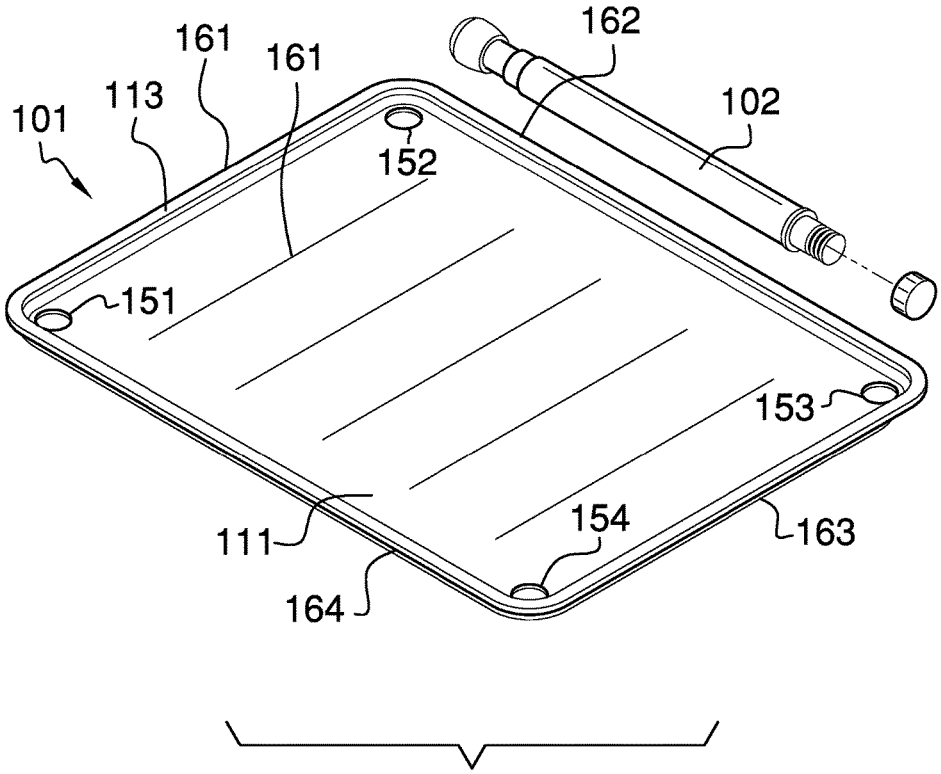
FIG. 1 is a perspective view of an embodiment of the disclosure.
Figure 2:
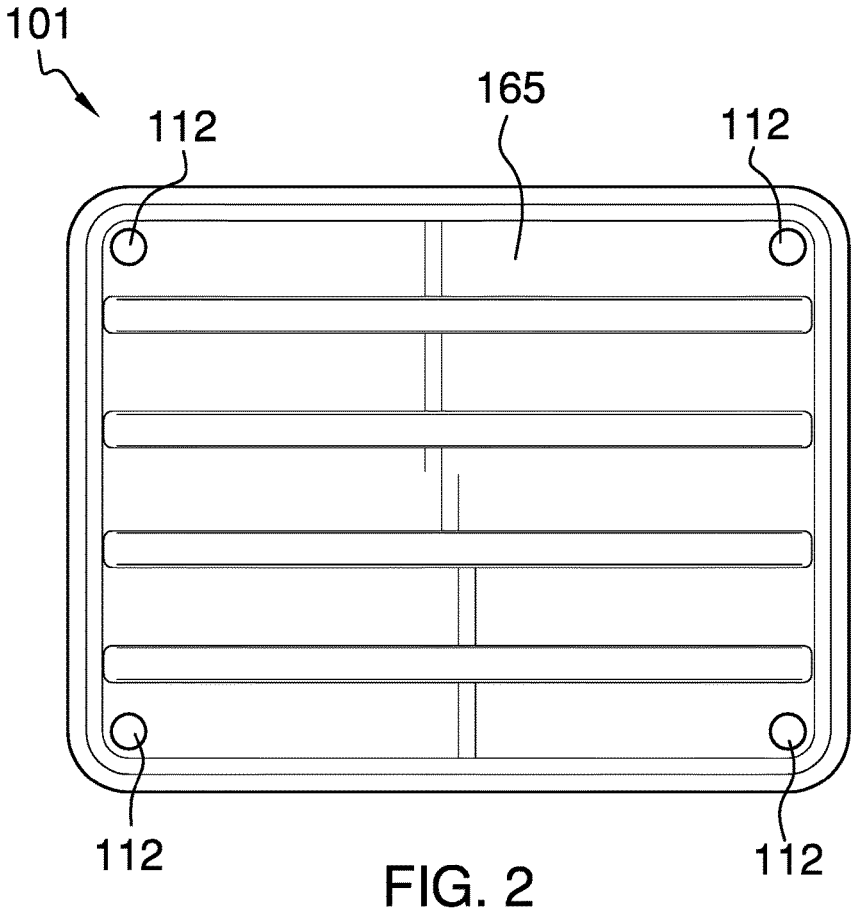
FIG. 2 is a bottom view of an embodiment of the disclosure.
Figure 3:
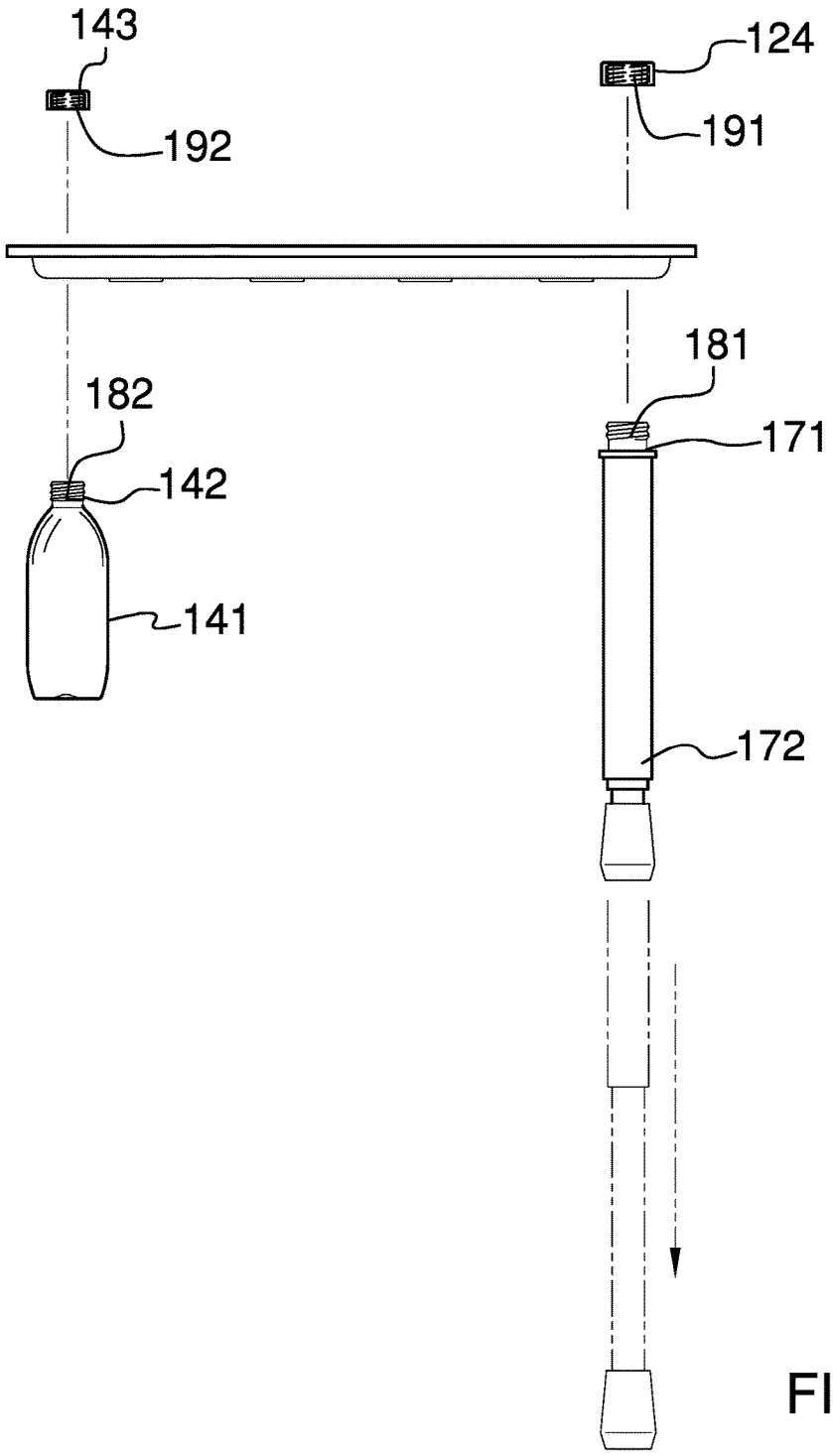
FIG. 3 is a side view of an embodiment of the disclosure.
Figure 4:
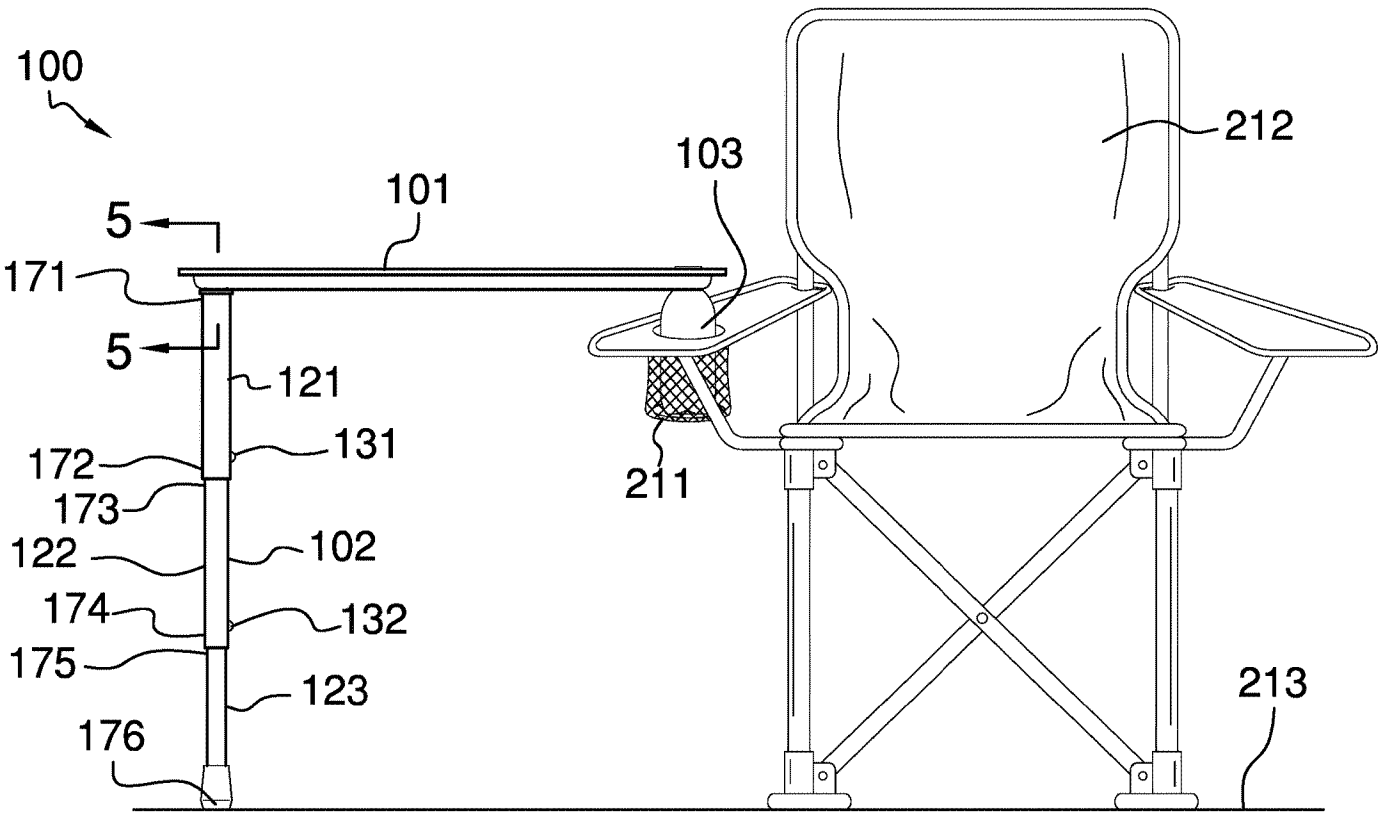
FIG. 4 is an in-use view of an embodiment of the disclosure.
Figure 5:
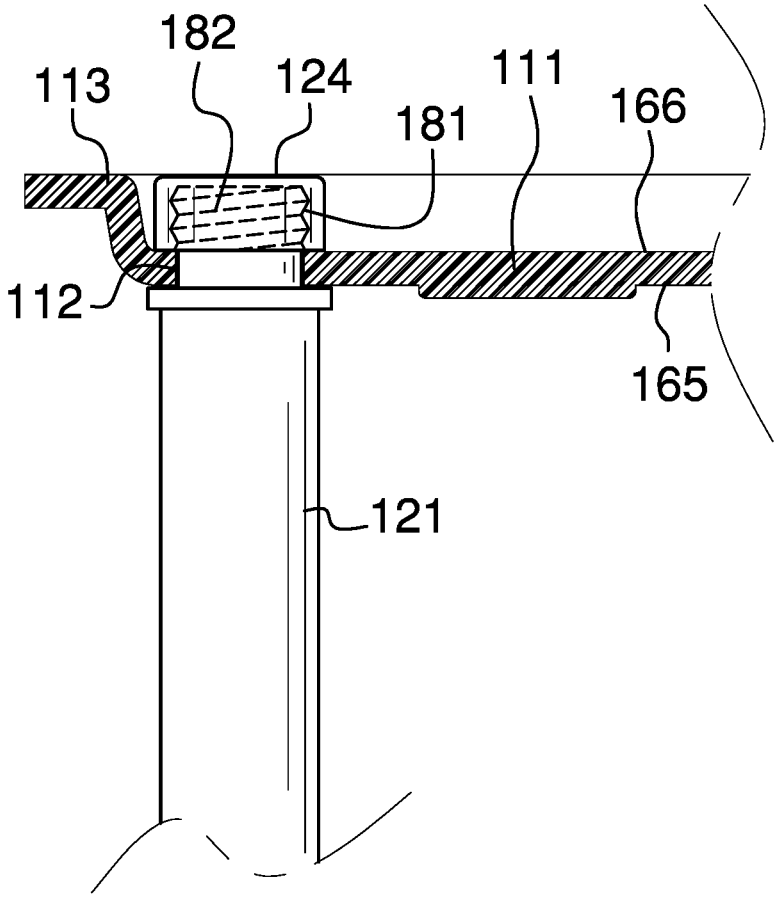
FIG. 5 is a cross-sectional view of an embodiment of the disclosure across 5-5 as shown in FIG. 4.
Figure 6:
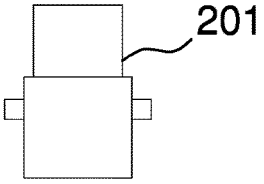
FIG. 6 is a side view of an embodiment of the disclosure.
Figure 11:
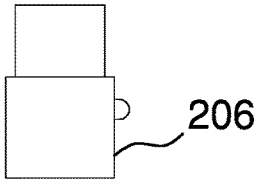
FIG. 11 is a side view of an embodiment of the disclosure.
Figure 7:
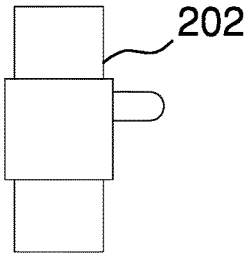
FIG. 7 is a side view of an embodiment of the disclosure.
Figure 10:
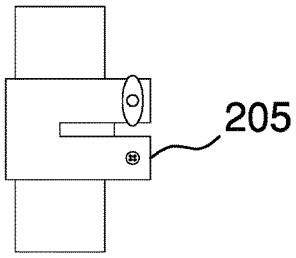
FIG. 10 is a side view of an embodiment of the disclosure.
Figure 9:
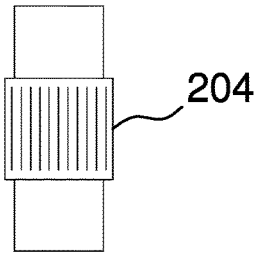
FIG. 9 is a side view of an embodiment of the disclosure.
Figure 8:
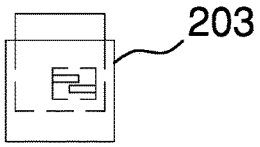
FIG. 8 is a side view of an embodiment of the disclosure.

Detailed reference will now be made to one or more potential embodiments of the disclosure, which are illustrated in FIGS. 1 through 11.

The portable tray for a folding chair 100 (hereinafter invention) is a table. The invention 100 is configured for use with a drink holder 211. In the first potential embodiment of the disclosure, the drink holder 211 is further defined with a chair 212. As used in this disclosure, a drink holder 211 refers to a cavity that is designated to hold a beverage contained in a can or a bottle. The invention 100 attaches to the drink holder 211 such that a portion of the load path of the invention 100 transfers through the drink holder 211 to the supporting surface 213 that supports the structure containing the drink holder 211. The invention 100 comprises a tray 101, a telescopic stanchion 102, and a stabilizer 103. The tray 101 is a horizontal surface that is used to support objects. The telescopic stanchion 102 is a vertical support that raises the tray 101 above the supporting surface 213. The stabilizer 103 is a device that attaches the tray 101 to the drink holder 211. The vertical span of the telescopic stanchion 102 is adjustable.

The tray 101 is a horizontal surface intended to receive objects. The tray 101 is positioned above the supporting surface 213 during normal use of the invention 100. The tray 101 comprises a working surface 111, a plurality of apertures 112, and a rim 113. The plurality of apertures 112 further comprises a first aperture 151, a second aperture 152, a third aperture 153, and a fourth aperture 154. The working surface 111 is further defined with a first edge 161, a second edge 162, a third edge 163, a fourth edge 164, an inferior surface 165, and a superior surface 166.

The working surface 111 forms the horizontal surface that is used to support objects during normal use of the invention 100. The working surface 111 is a plate structure. The rim 113 is a ridge formed along the perimeter of the superior surface 166 of the working surface 111. The rim 113 prevents objects from sliding laterally off the working surface 111. The superior surface 166 and the rim 113 always form the superior surface 166 of the invention 100.

Each of the plurality of apertures 112 is an aperture formed through the working surface 111 from the superior surface 166 to the inferior surface 165. Each of the plurality of apertures 112 is identical. The telescopic stanchion 102 attaches to the tray 101 using an aperture selected from the plurality of apertures 112. The stabilizer 103 attaches to the tray 101 using an aperture selected from the plurality of apertures 112.

The first aperture 151 is an aperture selected from the plurality of apertures 112 that is proximal to the corner formed by the fourth edge 164 and the first edge 161 of the working surface 111. The second aperture 152 is an aperture selected from the plurality of apertures 112 that is proximal to the corner formed by the first edge 161 and the second edge 162 of the working surface 111. The third aperture 153 is an aperture selected from the plurality of apertures 112 that is proximal to the corner formed by the second edge 162 and the third edge 163 of the working surface 111. The fourth aperture 154 is an aperture selected from the plurality of apertures 112 that is proximal to the corner formed by the third edge 163 and the fourth edge 164 of the working surface 111.

During normal use of the invention 100, diametrically opposed apertures are selected for the attachment of the telescopic stanchion 102 and the stabilizer 103 to the tray 101. Specifically, this means that if the telescopic stanchion 102 attaches to the first aperture 151 then the stabilizer 103 will attach to the third aperture 153. The telescopic stanchion 102 attaches to the second aperture 152 then the stabilizer 103 will attach to the fourth aperture 154. The telescopic stanchion 102 attaches to the third aperture 153 then the stabilizer 103 will attach to the first aperture 151. The telescopic stanchion 102 attaches to the fourth aperture 154 then the stabilizer 103 will attach to the second aperture 152.

The telescopic stanchion 102 is a vertical support that creates a load path between the tray 101 and the supporting surface 213. The telescopic stanchion 102 is a telescopic structure. The telescopic stanchion 102 directly transfers a portion of the load path created by the tray 101 to the supporting surface 213. The span of the telescopic stanchion 102 is adjustable such that the vertical position of the tray 101 is adjustable. The adjustable span of the telescopic stanchion 102 allows for the potential variation of elevation of a drink holder 211 selected from a plurality of drink holders 211.

The telescopic stanchion 102 further comprises a first arm 121, a second arm 122, and a first detent 131. The first detent 131 connects the second arm 122 to the first arm 121. The first arm 121 is further defined with a first end 171 and a second end 172. The second arm 122 is further defined with a third end 173 and a fourth end 174. The first arm 121 is a hollow first rigid prism that is further defined with an inner dimension and an outer dimension. The second arm 122 is a second hollow rigid prism that is further defined with an outer dimension. The first arm 121 and the second arm 122 are geometrically similar. The outer dimension of the second arm 122 is less than the inner dimension of the first arm 121 such that the second arm 122 can be inserted into the first arm 121 in a telescopic manner. This telescopic arrangement of the telescopic stanchion 102 allows the length of the telescopic stanchion 102 to be adjusted by adjusting the relative position of the second arm 122 within the first arm 121. The position of the second arm 122 relative to the first arm 121 is held in position using the first detent 131. The first detent 131 is a mechanical device that connects and secures the first arm 121 to the second arm 122. As shown most clearly in FIGS. 5 to 11, the first detent 131 is selected from the group consisting of a cotter pin 201, a G snap collar 202, a cam lock collar 203, a threaded clutch 204, a split collar lock 205, or a spring loaded ball lock 206.

The telescopic stanchion 102 further comprises a third arm 123 and a second detent 132. The second detent 132 connects the third arm 123 to the second arm 122. The second arm 122 is further defined with an inner dimension. The third arm 123 is further defined with a fifth end 175 and a sixth end 176. The third arm 123 is a third rigid prism that is further defined with an outer dimension. The second arm 122 and the third arm 123 are geometrically similar. The outer dimension of the third arm 123 is less than the inner dimension of the second arm 122 such that the third arm 123 can be inserted into the second arm 122 in a telescopic manner. This telescopic arrangement of the telescopic stanchion 102 allows the length of the telescopic stanchion 102 to be adjusted by adjusting the relative position of the third arm 123 within the second arm 122. The position of the third arm 123 relative to the second arm 122 is held in position using the second detent 132. The second detent 132 is a mechanical device that connects and secures the second arm 122 to the third arm 123. As shown most clearly in FIGS. 5 to 11, the second detent 132 is selected from the group consisting of a cotter pin 201, a G snap collar 202, a cam lock collar 203, a threaded clutch 204, a split collar lock 205, or a spring loaded ball lock 206.

The outer dimension of the first arm 121 is lesser than the inner dimension of any aperture selected from the plurality of apertures 112 such that the first end 171 of the first arm 121 can be inserted through the selected aperture. The first end 171 of the first arm 121 is formed with the first exterior screw thread 181. The first cap 124 is a capped tube. The interior surface of the first cap 124 is further formed with the first interior screw thread 191 such that the first cap 124 can screw onto the first end 171 of the first arm 121.

The first exterior screw thread 181 is an exterior screw thread formed on the first end 171 of the first arm 121. The first interior screw thread 191 is an exterior screw thread formed on the interior surface of the first cap 124. The use of an interior screw thread and an exterior screw thread is well known and documented in the mechanical arts. The interior screw thread and exterior screw thread are discussed in greater detail elsewhere in this disclosure.

The stabilizer 103 is an apparatus that attaches the tray 101 to the drink holder 211. The stabilizer 103 transfers a portion of the load created by the tray 101 to the load path that supports the drink holder 211. The stabilizer 103 inserts into the drink holder 211. The stabilizer 103 comprises a bottle 141, a neck 142, and a second cap 143. The neck 142 further comprises a second exterior screw thread 182. The second cap 143 further comprises a second interior screw thread 192.

The bottle 141 is a tubular container that is commonly used to store consumable beverages. The neck 142 is a cylindrical structure formed on the bottle 141 that accommodates the introduction of fluids into and removable of fluids from the bottle 141. The second cap 143 is a capped tube that attaches to the neck 142 of the bottle 141 using a threaded connection. The use of a threaded connection is well known and documented in the mechanical arts. The threaded connection is discussed in greater detail elsewhere in this disclosure. The use of a bottle 141 including the neck 142 and associated cap is well known and documented in the mechanical and chemical arts.

The second exterior screw thread 182 is an exterior screw thread formed on the neck 142 of the bottle 141 that forms the stabilizer 103. The second interior screw thread 192 is an interior screw thread formed on the interior surface of the second cap 143. The use of an interior screw thread and an exterior screw thread is well known and documented in the mechanical arts. The interior screw thread and exterior screw thread are discussed in greater detail elsewhere in this disclosure.

The third end 173 of the second arm 122 inserts into the second end 172 of the first arm 121 and is secured in position by the first detent 131. The fifth end 175 of the third arm 123 inserts into the fourth end 174 of the second arm 122 and is secured in position by the second detent 132. The telescopic stanchion 102 attaches to the tray 101 by: 1) inserting the first end 171 of the first arm 121 through the selected aperture and screwing the first cap 124 on the first end 171 such that the combination of the first end 171 and the first cap 124 will not fit through the selected aperture. The bottle 141 is placed in the drink holder 211 to stabilize the invention 100. The use of the drink holder 211 prevents lateral motion of the invention during normal use.

The following definitions were used in this disclosure:

Bottle: As used in this disclosure, a bottle is a container used for the storage of fluids. Access to the interior of a bottle is gained through the neck of the bottle. The neck is an elongated tube that forms an aperture through which fluids can be introduced and removed from the bottle.

Capped Tube: As used in this disclosure, a capped tube is a tube with one closed end and one open end.

Cavity: As used in this disclosure, a cavity is an empty space or negative space that is formed within an object.

Correspond: As used in this disclosure, the term correspond is used as a comparison between two or more objects wherein one or more properties shared by the two or more objects match, agree, or align almost exactly.

Exterior Screw Thread: An exterior screw thread is a ridge wrapped around the outer surface of a tube in the form of a helical structure that is used to convert rotational movement into linear movement.

Force of Gravity: As used in this disclosure, the force of gravity refers to a vector that indicates the direction of the pull of gravity on an object at or near the surface of the earth.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity.

Inner Dimension: As used in this disclosure, the term inner dimension describes the span from a first inside or interior surface of a container to a second inside or interior surface of a container. The term is used in much the same way that a plumber would refer to the inner diameter of a pipe.

Interior Screw Thread: An interior screw thread is a groove that is formed around the inner surface of a tube in the form of a helical structure that is used to convert rotational movement into linear movement.

Lateral: As used in this disclosure, the term lateral refers to motion in a direction that is perpendicular to the direction of the force of gravity.

Load Path: As used in this disclosure, a load path refers to a chain of one or more structures that transfers a load generated by a raised structure or object to a foundation, supporting surface, or the earth.

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Perimeter: As used in this disclosure, a perimeter is one or more curved or straight lines that bounds an enclosed area on a plane or surface. The perimeter of a circle is commonly referred to as a circumference.

Plate: As used in this disclosure, a plate is a smooth, flat and semi-rigid or rigid structure that has at least one dimension that: 1) is of uniform thickness; and 2) that appears thin relative to the other dimensions of the object. Plates often have a rectangular or disk-like appearance.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rim: As used in this disclosure, a rim is an outer edge or border that follows along the perimeter of an object.

Screw: As used in this disclosure, to screw is a verb meaning: 1) to fasten or unfasten (unscrew) a threaded connection; or 2) to attach a helical structure to a solid structure.

Stanchion: As used in this disclosure, a stanchion refers to a vertical pole, post, or support.

Superior: As used in this disclosure, the term superior refers to a directional reference that is parallel to and in the opposite direction of the force of gravity.

Supporting Surface: As used in this disclosure, a supporting surface is a horizontal surface upon which an object is placed. Within this disclosure, it is assumed that the object is placed on the supporting surface in an orientation that is appropriate for the normal or anticipated use of the object.

Telescopic: As used in this disclosure, telescopic is an adjective that describes an object made of sections that fit or slide into each other such that the object can be made longer or shorter by adjusting the relative positions of the sections.

Threaded Connection: As used in this disclosure, a threaded connection is a type of fastener that is used to join a first tube-shaped and a second tube-shaped object together. The first tube-shaped object is fitted with a first fitting selected from an interior screw thread or an exterior screw thread. The second tube-shaped object is fitted with the remaining screw thread. The tube-shaped object fitted with the exterior screw thread is placed into the remaining tube-shaped object such that: 1) the interior screw thread and the exterior screw thread interconnect; and, 2) when the tube-shaped object fitted with the exterior screw thread is rotated the rotational motion is converted into linear motion that moves the tube-shaped object fitted with the exterior screw thread either into or out of the remaining tube-shaped object. The direction of linear motion is determined by the direction of rotation.

Tray: As used in this disclosure, a tray is a flat plate-like structure that has a raised rim formed around the perimeter for the purpose of containing fluids within the structure of the tray. Trays will generally give an impression of being a shallow containment device. Trays are often used for carrying food and drink or for holding small items.

Tube: As used in this disclosure, a tube is a hollow prism-shaped device used for transporting liquids and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 11 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A table comprising:

wherein the table comprises a tray, a telescopic stanchion, and a stabilizer;

wherein the tray forms a horizontal surface;

wherein the telescopic stanchion is a vertical support;

wherein the stabilizer is a device that attaches the tray to a drink holder of a chair;

wherein the table attaches to the drink holder of said chair such that a portion of the load path of the table transfers through the drink holder of said chair to the supporting surface that supports the chair;

wherein the telescopic stanchion is a vertical support that raises the tray above a supporting surface;

wherein the telescopic stanchion is a telescopic structure;

wherein the telescopic stanchion is a vertical support that creates a load path between the tray and the supporting surface;

wherein the telescopic stanchion directly transfers a portion of the load path created by the tray to the supporting surface;

wherein the span of the telescopic stanchion is adjustable;

wherein the stabilizer is an apparatus that attaches the tray to the drink holder;

wherein the stabilizer transfers a portion of the load created by the tray to the load path that supports the drink holder;

wherein the stabilizer inserts into the drink holder;

wherein the tray comprises a working surface, a plurality of apertures, and a rim;

wherein the plurality of apertures are formed in the working surface;

wherein the rim attaches to the working surface;

wherein the working surface is further defined with a first edge, a second edge, a third edge, a fourth edge, an inferior surface, and a superior surface.

2. The table according to claim 1 wherein the working surface forms the horizontal surface;

wherein the working surface is a plate structure;

wherein the rim is a ridge formed along the perimeter of the superior surface of the working surface.

3. The table according to claim 2 wherein each of the plurality of apertures is an aperture formed through the working surface from the superior surface to the inferior surface;

wherein each of the plurality of apertures is identical.

4. The table according to claim 3 wherein the telescopic stanchion attaches to the tray using an aperture selected from the plurality of apertures.

5. The table according to claim 4 wherein the stabilizer attaches to the tray using an aperture selected from the plurality of apertures.

6. The table according to claim 5 wherein the plurality of apertures further comprises a first aperture, a second aperture, a third aperture, and a fourth aperture;

wherein the first aperture is an aperture selected from the plurality of apertures that is proximal to the corner formed by the fourth edge and the first edge of the working surface;

wherein the second aperture is an aperture selected from the plurality of apertures that is proximal to the corner formed by the first edge and the second edge of the working surface;

wherein the third aperture is an aperture selected from the plurality of apertures that is proximal to the corner formed by the second edge and the third edge of the working surface;

wherein the fourth aperture is an aperture selected from the plurality of apertures that is proximal to the corner formed by the third edge and the fourth edge of the working surface.

7. The table according to claim 6 wherein two diametrically opposed apertures are selected from the plurality of apertures for the attachment of the telescopic stanchion and the stabilizer to the tray;

wherein the diametrically opposed apertures are selected from the group consisting of A) the telescopic stanchion attaches to the first aperture and the stabilizer attaches to the third aperture; B) the telescopic stanchion attaches to the second aperture and the stabilizer attaches to the fourth aperture; C) the telescopic stanchion attaches to the third aperture and the stabilizer attaches to the first aperture; and, D) the telescopic stanchion attaches to the fourth aperture and the stabilizer attaches to the second aperture.

8. The table according to claim 7 wherein the telescopic stanchion further comprises a first arm, a second arm, and a first detent;

wherein the first detent connects the second arm to the first arm;

wherein the first arm is further defined with a first end and a second end;

wherein the second arm is further defined with a third end and a fourth end.

9. The table according to claim 8 wherein the first arm is a hollow first rigid prism;

wherein the second arm is a second hollow rigid prism;

wherein the first arm is further defined with an inner dimension and an outer dimension;

wherein the is further defined with an outer dimension;

wherein the first arm and the second arm are geometrically similar;

wherein the outer dimension of the second arm is less than the inner dimension of the first arm such that the second arm inserts into the first arm;

wherein the position of the second arm relative to the first arm is held in position using the first detent;

wherein the first detent is a mechanical device.

10. The table according to claim 9 wherein the telescopic stanchion further comprises a third arm and a second detent;

wherein the second detent connects the third arm to the second arm;

wherein the second arm is further defined with an inner dimension;

wherein the third arm is further defined with a fifth end and a sixth end.

11. The table according to claim 10 wherein the third arm is a third rigid prism;

wherein the third arm is further defined with an outer dimension;

wherein the second arm and the third arm are geometrically similar;

wherein the outer dimension of the third arm is less than the inner dimension of the second arm such that the third arm inserts into the second arm;

wherein the position of the third arm relative to the second arm is held in position using the second detent;

wherein the second detent is a mechanical device.

12. The table according to claim 11 wherein the span of the length of the telescopic stanchion is adjusted by adjusting the relative position of the second arm within the first arm;

wherein the span of the length of the telescopic stanchion is adjusted by adjusting the relative position of the third arm within the second arm.

13. The table according to claim 12 wherein the outer dimension of the first arm is lesser than the inner dimension of any aperture selected from the plurality of apertures such that the first end of the first arm inserts through the selected aperture.

14. The table according to claim 13 wherein the first end of the first arm is formed with the first exterior screw thread;

wherein the first cap is a capped tube;

wherein the interior surface of the first cap is further formed with the first interior screw thread such that the first cap can screw onto the first end of the first arm;

wherein the first exterior screw thread is an exterior screw thread formed on the first end of the first arm;

wherein the first interior screw thread is an exterior screw thread formed on the interior surface of the first cap.

15. The table according to claim 14 wherein the stabilizer comprises a bottle, a neck, and a second cap;

wherein the neck attaches the bottle to the second cap;

wherein the neck further comprises a second exterior screw thread;

wherein the second cap further comprises a second interior screw thread;

wherein the second cap is a capped tube that attaches to the neck of the bottle using a threaded connection.

16. The table according to claim 15 wherein the third end of the second arm inserts into the second end of the first arm and is secured in position by the first detent;

wherein the fifth end of the third arm inserts into the fourth end of the second arm and is secured in position by the second detent;

wherein the first end of the first arm through the selected aperture and screwing the first cap on the first end such that the combination of the first end and the first cap will not fit through the selected aperture;

wherein the bottle inserts into the drink holder.

17. The table according to claim 16 wherein the first detent is selected from the group consisting of a cotter pin, a G snap collar, a cam lock collar, a threaded clutch, a split collar lock, or a spring loaded ball lock;

wherein the second detent is selected from the group consisting of a cotter pin, a g snap collar, a cam lock collar, a threaded clutch, a split collar lock, or a spring loaded ball lock.

* * * * *